United States Patent [19]

Swanson

[11] Patent Number: 4,618,815

[45] Date of Patent: Oct. 21, 1986

[54] MIXED THRESHOLD CURRENT MIRROR

[75] Inventor: Eric J. Swanson, Reading, Pa.

[73] Assignee: AT&T Bell Laboratories, Murray Hill, N.J.

[21] Appl. No.: 700,029

[22] Filed: Feb. 11, 1985

[51] Int. Cl.[4] ..... G05F 3/26

[52] U.S. Cl. ..... 323/315; 330/288

[58] Field of Search ..... 323/315, 316; 330/277, 330/288; 307/304

[56] References Cited

U.S. PATENT DOCUMENTS

| | | | |
|---|---|---|---|
| 3,868,274 | 2/1975 | Hubar et al. | 148/1.5 |
| 3,895,966 | 7/1975 | MacDougall et al. | 148/1.5 |
| 4,052,229 | 10/1977 | Pashley | 148/1.5 |
| 4,281,261 | 7/1981 | Adam | 307/270 |
| 4,300,091 | 11/1981 | Schade | 323/316 |
| 4,327,321 | 4/1982 | Suzuki et al. | 323/315 |
| 4,399,374 | 8/1983 | Boeke | 323/316 |
| 4,414,503 | 11/1983 | Hashimoto | 323/315 |
| 4,477,782 | 10/1984 | Swanson | 330/288 |
| 4,550,284 | 10/1985 | Sooch | 323/315 |

FOREIGN PATENT DOCUMENTS

| | | | |
|---|---|---|---|
| 52553 | 5/1982 | European Pat. Off. | 323/315 |

OTHER PUBLICATIONS

"Threshold Adjustment of N-Channel . . .", 1973 *IEDM*, 12/73, P. Peressini et al, pp. 467–468.

*Primary Examiner*—William H. Beha, Jr.
*Attorney, Agent, or Firm*—Wendy W. Koba

[57] ABSTRACT

An MOS current mirror arrangement is disclosed wherein selected ones of the input and output transistors are designed to have a threshold voltage, $V_{T1}$, greater in magnitude that associated with standard MOS devices. The larger threshold voltage thus eases the requirement that the turn-on voltage, $V_{ON}$, remain less than the threshold voltage $V_T$, for the devices to remain in the active region of operation. Since a minimum value of $V_T$ is useful for some applications (fast processing and operation at high temperatures) the use of mixed thresholds allows both requirements to be met by adjusting the thresholds of selected devices associated with these different requirements. The difference in threshold voltages can be attained simply by adjusting the threshold adjust implant mask to protect selected devices from the ion implantation conventionally used to decrease the magnitude of the threshold voltage.

6 Claims, 1 Drawing Figure

MIXED THRESHOLD CURRENT MIRROR

BACKGROUND OF THE INVENTION

1. Field of the Invention

The present invention relates to an MOS current mirror and, more particularly, to an MOS current mirror circuit which utilizes pairs of MOS transistors with differing threshold voltages, $V_{T1}$ and $V_{T2}$, to minimize the circuit performance restrictions related to the magnitude of the threshold voltage.

2. Description of the Prior Art

A current mirror is a type of current amplifier which provides a high impedance output current proportional to an input current. As MOS (metal-oxide-semiconductor) devices gain in popularity, the demand increases for various circuits, including current mirrors, which can be formed from MOS devices. One such MOS current mirror arrangement is disclosed in U.S. Pat. No. 4,327,321 issued to H. Suzuki et al on Apr. 27, 1982. The Suzuki et al circuit also includes a resistor in the input rail between a p-channel MOSFET and an n-channel MOSFET to minimize the output current dependency on variations in the power supply.

There are presently two conflicting trends in the design of MOS circuits. One is a trend toward MOS devices with shorter conduction channel lengths for accommodating higher signal frequencies. The other is a trend toward lower supply voltages for reducing power consumption, so that more devices may be included in a single circuit for integration on a single chip. The conflict arises in that as the devices of a current mirror have their channel lengths shortened, their transconductance rises, but their output conductance rises even faster. The resulting lower available current mirror output impedance has led to combined arrangements of two or more mirrors in which the output transistors are connected in series. These arrangements, however, require increased power supply voltage, or overhead, for obtaining increased output impedance since each of the output transistors requires sufficient drain-to-source voltage, $V_{DS}$, to be biased in saturation.

One solution to this problem is the compound current mirror arrangement which includes input transistors having separate and equal conduction path currents but different conduction path geometries. U.S. Pat. No. 4,477,782 issued on Oct. 16, 1984 to the present applicant, E. J. Swanson and assigned to the assignee of the present application, discloses in detail this compound arrangement with differing conduction path geometries. Basically, the geometries of the input transistors are related to each other in such a manner that they result in gate bias voltages which optimize the $V_{DS}$ of the output transistors. For a dual pair combination with MOS devices, one of the input transistors has a conduction channel width-to-length ratio W/L which is at least four times that of the other input transistor device. Although useful, the circuit disclosed in U.S. Pat. No. 4,477,782 is limited in application by the value of the threshold voltage, $V_T$, associated with the MOS devices. At the completion of a conventional manufacturing process, the threshold voltage $V_T$ of an MOS device has a magnitude of approximately 0.7 V (−0.7 V for p-channel devices and +0.7 V for n-channel devices). For the transistors to remain in saturation, the turn-on voltage of the device, $V_{ON}$, must be less than $V_T$. Insuring that $V_{ON}$ remains less than $V_T$ becomes a problem for low $V_T$ processing or high temperature operation.

SUMMARY OF THE INVENTION

The problem remaining in the prior art has been solved in accordance with the present invention which relates to an MOS current mirror and, more particularly, to a compound MOS current mirror circuit which utilizes pairs of MOS transistors with differing threshold voltages, $V_{T1}$ and $V_{T2}$, to minimize the circuit performance restrictions related to the magnitude of the threshold voltage.

It is an aspect of the present invention to provide different threshold voltages merely by altering the conventional threshold adjustment implant process so as not to allow the implant access to certain selected devices.

A further aspect of the present invention is to achieve the alteration in the threshold adjust implant by simply reconfiguring the conventional mask used during the implant process to protect the selected transistors from the implantation process.

Other and further aspects of the present invention will become apparent during the course of the following discussion and by reference to the accompanying drawing.

BRIEF DESCRIPTION OF THE DRAWING

The FIGURE is a schematic circuit diagram of a compound current mirror formed in accordance with the present invention where the lower plurality of transistors are formed to comprise a first threshold voltage $V_{T1}$, and the upper plurality of transistors are formed to comprise a second threshold voltage $V_{T2}$.

DETAILED DESCRIPTION

Figure 1:
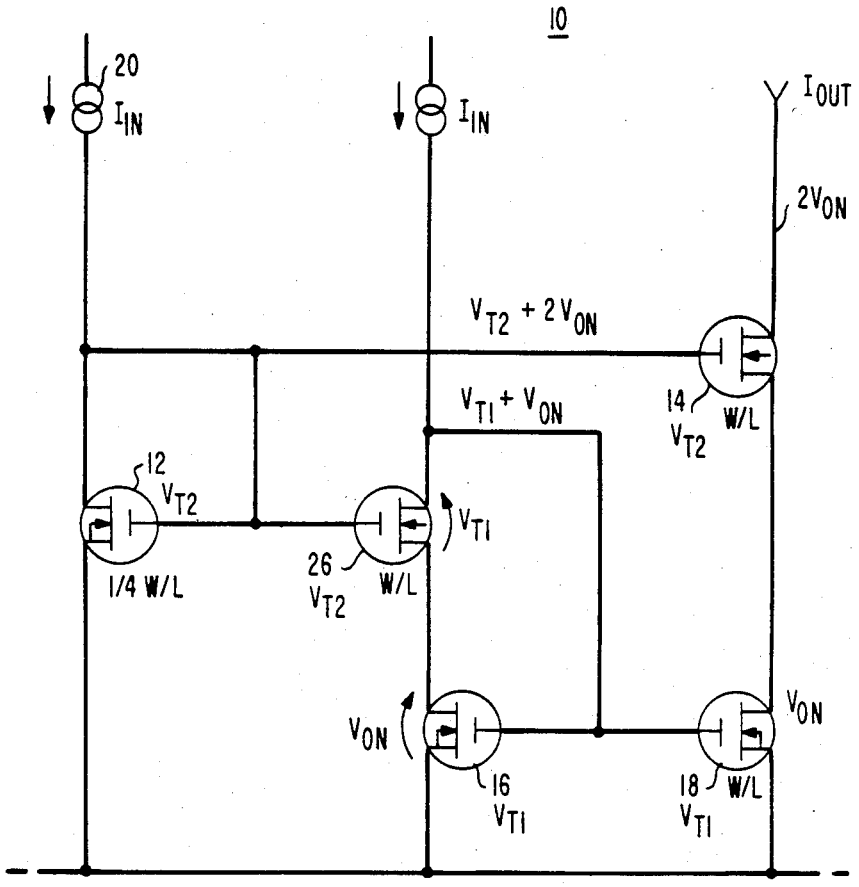

As previously stated, a current mirror is a type of current amplifier which provides a high impedance output current proportional to an input current. The output current is typically used to drive a load for high gain. A simple mirror generally consists of a single input and a single output transistor pair, with the gate electrodes of the pair being tied together and to an input voltage node at the drain of the input transistor. The sources of the transistors are connected to a reference voltage node which is common to both. The drain and gate of the input transistor are connected to a current source which provides a quiescent reference current. Since the input and output transistors have their gates and sources tied together, a corresponding output current arises in the conduction path of the output transistor. Generally, the input and output transistors are identical and there is a substantially unity gain in the current.

A compound current mirror 10 formed in accordance with the present invention which includes transistors having at least two different threshold voltages is illustrated in the FIGURE. Current mirror 10 includes an upper input and output pair of transistors 12, 14 and a lower input and output pair of transistors 16, 18. All of the transistors illustrated in FIG. 1 are n-channel enhancement mode devices. However, it is to be understood that a like current mirror of the present invention may be formed with p-channel devices (as shown in phantom in association with transistor 12), where only the polarity of the power supply and reference voltages need to be reversed. Upper transistors 12 and 14 have their gates connected together and tied to the drain of upper input transistor 12 to form a cascode arrangement. Lower transistors 16 and 18 have their gates connected together in a similar fashion. Upper input transistor 12 has its conduction path connected between a first current source 20 and a reference node 22, where reference node 22 may be defined as VSS for n-channel devices or VDD for p-channel devices. Lower input transistor 16 has its conduction path from a second current source 24 to reference node 22. As shown in the FIGURE, an equalizing transistor 26 is connected between the drain of lower input transistor 16 and second current source 24. The gate of lower input transistor 16 is connected to the drain of equalizing transistor 26. The gate of equalizing transistor 26 is connected to the gates of upper input and output transistors 12 and 14. The presence of equalizing transistor 26 assures that the $V_{DS}$ of lower input transistor 16 will be substantially equal to the $V_{DS}$ of lower output transistor 18, thereby virtually eliminating any current offset in mirror 10 between input current path 24 and $I_{OUT}$.

Current sources 20 and 24 are designed so that in the quiescent state equal reference currents $I_{ref}$ flow through the conduction paths of input transistors 12 and 16. Since MOS devices are "square law" devices, their drain current is related to their gate-source voltage $V_{GS}$ by a polynomial expression which can be simplified to the form $$I_D \alpha (W/L)(V_{GS}-V_T)^2 \quad (1)$$

where $I_D$ is the drain-to-source current, of the conduction path current,

W/L is the channel width-to-length ratio, $V_{GS}$ is the gate-to-source voltage, and $V_T$ is the threshold voltage of the device.

By virtue of the $\frac{1}{4}$ W/L geometry of upper input transistor 12, derived and explained in detail in above-cited U.S. Pat. No. 4,477,782, the gate bias voltages of the upper and lower portions of mirror 10 are determined so that in the quiescent state both output transistors 14 and 18 can operate at their $V_{ON}$ point, which is a voltage just high enough for saturation.

Referring to the FIGURE, it can be seen that since $V_{DS}$ of lower input transistor 16 is equal to $V_{ON}$, and the voltage between the gates of transistors 16, 18 and reference node 22 is equal to $V_{T1}+V_{ON}$, the voltage between the drain and source of equalizing transistor 26, $V_{DS}$, must be equal to $V_{T1}$. In order for the circuit to operate correctly, equalizing transistor 26, like the input and output transistors, must remain in saturation. That is, $V_{DS}$ (i.e., $V_{T1}$) must be greater than $V_{ON}$. As stated above, this requirement becomes troublesome for circuits with fast processing and high operating temperatures, since a minimum value of $V_T$ is realized under these conditions. During a conventional manufacturing process, the threshold voltage, $V_T$, of MOS devices is changed during a process referred to as a threshold adjust implant. That is, the circuit is ion implanted with a dopant, for example, boron, to modify the threshold voltage. For p-channel devices, the implant raises $V_T$ from a value of approximately $-1.5$ V to $-0.8$ V. A complete discussion of the actual implantation process can be found in the article "Threshold Adjustment of N-Channel Enhancement Mode FETs by Ion Implantation", by P. Peressini et al appearing in the Technical Digest of the 1973 International Electron Devices Meeting, December 1973, at pp. 467–8.

In association with the threshold adjust process, the present invention provides a circuit which considerably eases the $V_{ON}<V_T$ requirement for equalizing transistor 26 by removing the threshold adjust implant from lower input and output transistors 16 and 18. Therefore, for the n-channel arrangement illustrated in the FIGURE, the threshold voltage $V_T$ of lower transistors 16 and 18, denoted $V_{T1}$, is approximately equal to $+1.5$ V. Similar to conventional arrangements, the threshold voltage of transistors 12 and 14, denoted $V_{T2}$, is adjusted to the value of $+0.7$ V. Thus, in accordance with the present invention, the drain-to-source voltage $V_{DS}$ ($=V_T$) across equalizing transistor 26 will be equal to the nominal value of $+1.5$ V, instead of the conventional threshold adjusted value of $+0.7$ V. Therefore, the requirement of $V_{ON}<V_T$ is eased by an amount equal to the difference between the non-adjusted and the adjusted threshold voltages of transistors 16 and 18. In this example, an additional $+0.8$ V margin is attained.

In order to provide lower transistors 16 and 18 with the nominal threshold value of $+1.5$ V, while still implanting upper transistors 12 and 14 to achieve the lower threshold of $+0.7$, the identical threshold adjust implant process of the prior art may be used, with only a modification of the threshold adjust mask being required to protect the lower transistors from implantation. Alternatively, a more complicated process may be used which requires two mask levels and two implants, to provide voltages levels other than those discussed above. For most applications, however, the simple modification of the threshold adjust mask is sufficient to achieve the separate threshold voltages used in association with the present invention.

What is claimed is:

1. An MOS current amplifying apparatus comprising at least two input MOS transistors, each having a conduction path and a gate electrode, the conduction paths being connected in parallel with each other;

means for providing an input current to each transistor of said at least two input MOS transistors;

at least two output MOS transistors associated in a one-to-one relationship with said at least two input MOS transistors, each output transistor having a conduction path and a gate electrode, the gate electrode of each of said at least two output transistors being coupled to a point in the input conduction path and also the gate electrode of said input transistor associated therewith, wherein at least one of said input transistors and at least one of said output transistors comprises a first threshold voltage ($V_{T1}$) greater in magnitude than a second threshold voltage ($V_{T2}$) associated with the remaining input and output transistors; and an equalizing MOS transistor including a drain, source and gate electrode, having its conduction path connected between one side of the conduction path of one of said at least two input transistors and the point at which the gate electrode of said one input transistor is connected to the input current path, said equalizing transistor providing currents of like magnitude to each input transistor and comprising a drain-to-source voltage equal to the first greater, threshold.

2. An MOS current amplifying apparatus as defined in claim 1 wherein the at least two input MOS transistors comprise a pair of MOS transistors, each transistor having a drain electrode, a source electrode, and a gate electrode, the drain and gate electrodes of a first MOS transistor of said pair of MOS transistors being connected together and coupled to a first current source of the current supplying means, the drain and gate electrodes of the remaining MOS transistor being connected together and coupled to a second current source of said current supplying means;

the at least two output MOS transistors comprise a pair of MOS transistors, each transistor having a drain electrode, a source electrode, and a gate electrode, said pair of output MOS transistors connected in series with each other, the gate electrode of a first output transistor of said pair of output transistors connected to the gate electrode of the first input transistor and the gate electrode of a second output transistor connected to the gate electrode of the second, remaining input transistor, the first input and first output transistor comprising the first threshold voltage, $V_{T1}$, and the second input and second output transistors comprising the second threshold voltage, $V_{T2}$.

3. An MOS current amplifying apparatus as defined in claim 1 wherein the at least two input transistors and at least two output transistors are n-channel MOS devices.

4. An MOS current amplifying apparatus as defined in claim 3 wherein the first threshold voltage associated with at least one of the input and at least one of the output transistors is approximately equal to +1.5 V and the second threshold voltage associated with the remaining input and remaining output transistors is approximately equal to +0.7 V.

5. An MOS current amplifying apparatus as defined in claim 1 wherein the at least two input transistors and at least two output transistors are p-channel MOS devices.

6. An MOS current amplifying apparatus as defined in claims 5 wherein the first threshold voltage associated with at least one of the input and at least one of the output transistors is approximately equal to −1.5 V and the second threshold voltage associated with the remaining input and remaining output transistors is approximately equal to −0.8 V.

* * * * *